US009780478B2

(12) United States Patent
Kamei

(10) Patent No.: US 9,780,478 B2
(45) Date of Patent: Oct. 3, 2017

(54) CONNECTOR AND CONNECTION STRUCTURE

(71) Applicant: Japan Aviation Electronics Industry, Limited, Tokyo (JP)

(72) Inventor: Yuji Kamei, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/364,514

(22) Filed: Nov. 30, 2016

(65) Prior Publication Data

US 2017/0222351 A1 Aug. 3, 2017

(30) Foreign Application Priority Data

Jan. 28, 2016 (JP) ..... 2016-014836

(51) Int. Cl.
*H01R 13/44* (2006.01)

(52) U.S. Cl.
CPC ..... *H01R 13/44* (2013.01)

(58) Field of Classification Search
CPC ..... H02G 5/007; H01R 25/162; H01R 13/44
USPC ..... 439/210–213; 174/88 B, 68.2
See application file for complete search history.

(56) References Cited

U.S. PATENT DOCUMENTS 3,639,676 A * 2/1972 Dempsey, Jr. ..... H02G 5/06 174/68.3
4,278,752 A * 7/1981 Gervay ..... H05K 3/287 430/271.1
4,728,752 A * 3/1988 Hicks, Jr. ..... H02G 5/007 174/71 B
6,755,673 B2 6/2004 Fukushima et al.
9,147,506 B2 9/2015 Okada et al.
2014/0364010 A1 12/2014 Kuwahara et al.

FOREIGN PATENT DOCUMENTS

JP H01-174815 U 12/1989
JP S63-075910 U 5/1998
JP 2002-343169 A 11/2002
JP 2006-310079 A 11/2006
JP 2012-182864 A 9/2012
JP 2014-238929 A 12/2014

* cited by examiner

*Primary Examiner* — Ross Gushi
(74) *Attorney, Agent, or Firm* — Collard & Roe, P.C.

(57) ABSTRACT

A connector comprises a housing, a contact and a connection structure. The connection structure is a structure other than the housing and comprises a conductive member, a protection portion and an electric-shock prevention portion. The conductive member has a first end portion and a second end portion. The first end portion is attached to or integrally formed with the contact. The protection portion covers a part of the conductive member, which is positioned between the first end portion and the second end portion. The housing has an accommodation portion formed therewithin. The accommodation portion has an opening. The contact is accommodated in the accommodation portion together with the first end portion of the conductive member. The electric-shock prevention portion, at least in part, blocks the opening of the accommodation portion and obstructs entrance of a finger into the accommodation portion beyond the electric-shock prevention portion.

14 Claims, 14 Drawing Sheets

CONNECTOR AND CONNECTION STRUCTURE

CROSS REFERENCE TO RELATED APPLICATIONS

This application is based on and claims priority under 35 U.S.C. §119 to Japanese Patent Application No. JP2016-014836 filed Jan. 28, 2016, the contents of which are incorporated herein in their entirety by reference.

BACKGROUND OF THE INVENTION

This invention relates to a large current connector which is, for example, used in an electric vehicle such as an electric car.

For example, this type of connector is disclosed in JP A 2014-238929 (Patent Document 1), the content of which is incorporated herein by reference.

Referring to FIG. 26, Patent Document 1 discloses a second connector (connector) 900 which comprises a second housing (housing) 910 made of insulator, two second power terminals (contacts) 920 each made of conductor and two cables 930 each coated with insulation. The cables 930 are connected to the contacts 920, respectively. The housing 910 has two accommodation portions 912 formed therewithin, wherein the accommodation portions 912 correspond to the contacts 920, respectively. Each of the accommodation portions 912 has an opening (not shown) which is positioned at a lower end, or the negative Z-side end, thereof. Each of the contacts 920 is inserted into the corresponding accommodation portion 912 from below together with an upper end, or the positive Z-side end, of the cable 930 and accommodated within the accommodation portion 912, so that electric shock, which might be caused because of contact with the conductive body such as the contacts 920 and the core wires of the cables 930, can be prevented.

Referring to FIGS. 26 and 27, the contact 920 is connected to a connection structure other than the cable 930 depending on usage of the connector 900. For example, the contact 920 is sometimes connected to a bus bar 940.

As described above, the contact may be connected to a variety of connection structures such as a cable and a bus bar depending on usage of the connector. The accommodation portion of the housing is preferred to have a shape which allows easy insertion of the specific connection structure which is actually connected to the contact. Therefore, the housing of the existing connector is formed so as to be suitable to the shape of the specific connection structure. However, there is a request that the housing is standardized for various connection structures so that manufacturing cost can be reduced.

SUMMARY OF THE INVENTION

It is therefore an object of the present invention to provide a connector which meets the aforementioned request.

When the housing is merely standardized, electric shock might be insufficiently prevented depending on the shape of the connection structure. For example, after a plate-like connection structure such as a bus bar is inserted in the accommodation portion, a gap might exist at the opening of the accommodation portion, and the gap might allow passage of a finger. In this case, the connector needs to comprise an insulating body (electric-shock prevention portion) which blocks the gap of the accommodation portion. This electric-shock prevention portion needs to be formed separately from the housing so that the housing can be standardized. In addition, from a view point of easy insertion of the connection structure into the accommodation portion, the electric-shock prevention portion needs to be provided so as to correspond to the connection structure. The present invention provides a connector which meets these various requests. Specifically, the present invention provides a connector described below.

An aspect of the present invention provides a connector having a fit portion fittable to a mating connector. The connector comprises a housing, a contact and a connection structure. The connection structure is a structure other than the housing and comprises a conductive member, a protection portion and an electric-shock prevention portion. The conductive member has a first end portion and a second end portion. The first end portion is attached to or integrally formed with the contact. The protection portion covers a part of the conductive member, which is positioned between the first end portion and the second end portion. The housing has an accommodation portion formed therewithin. The accommodation portion has a first opening and a second opening. The first opening is positioned at the fit portion. The second opening is positioned at a part other than the fit portion. The contact is accommodated in the accommodation portion together with the first end portion of the conductive member. The electric-shock prevention portion, at least in part, blocks the second opening of the accommodation portion and obstructs entrance of a finger into the accommodation portion beyond the electric-shock prevention portion.

Another aspect of the present invention provides a connector having a fit portion fittable to a mating connector. The connector comprises a housing, two or more contacts and two or more connection structures. The connection structures are separated from one another and correspond to the contacts, respectively. Each of the connection structures is a structure other than the housing and comprises a conductive member, a protection portion and an electric-shock prevention portion. In each of the connection structures, the conductive member has a first end portion and a second end portion, the first end portion is attached to or integrally formed with the corresponding contact, and the protection portion covers a part of the conductive member, which is positioned between the first end portion and the second end portion. The housing has two or more accommodation portions formed therewithin. The accommodation portions correspond to the contacts, respectively, and are separated from one another. Each of the accommodation portions has a first opening and a second opening. Each of the first openings is positioned at the fit portion. Each of the second openings is positioned at a part other than the fit portion. Each of the contacts is accommodated in the corresponding accommodation portion together with the first end portion of the conductive member of the corresponding connection structure. Each of the electric-shock prevention portions, at least in part, blocks the second opening of the corresponding accommodation portion and obstructs entrance of a finger into the accommodation portion beyond the electric-shock prevention portion.

Still another aspect of the present invention provides a connection structure attachable to a housing of a connector. The housing is formed with an accommodation portion having an opening. The connection structure comprises a conductive member, a protection portion and an electric-shock prevention portion. The conductive member has a first end portion and a second end portion. The protection portion covers a part of the conductive member, which is positioned between the first end portion and the second end portion.

Under a state where the connection structure is attached to the housing, the first end portion is accommodated in the accommodation portion, and the electric-shock prevention portion, at least in part, blocks the opening of the accommodation portion and obstructs entrance of a finger into the accommodation portion beyond the electric-shock prevention portion.

The connection structure according to an aspect of the present invention is a structure other than the housing. Moreover, the first end portion of the conductive member is attached to or integrally formed with the contact. For example, when the second opening of the accommodation portion is formed to be sufficiently large, any connection structure can be inserted into the accommodation portion through the second opening together with the contact. The housing with the aforementioned second opening can be standardized for various connection structures.

Moreover, according to an aspect of the present invention, the electric-shock prevention portion prevents electric shock. In detail, the electric-shock prevention portion, at least in part, blocks the opening of the accommodation portion and obstructs the entrance of the finger into the accommodation portion beyond the electric-shock prevention portion. Moreover, the electric-shock prevention portion is provided so as to correspond to the connection structure other than the housing. Therefore, the connection structure can be easily inserted into the accommodation portion while the housing is standardized.

An appreciation of the objectives of the present invention and a more complete understanding of its structure may be had by studying the following description of the preferred embodiment and by referring to the accompanying drawings.

Figure 1:
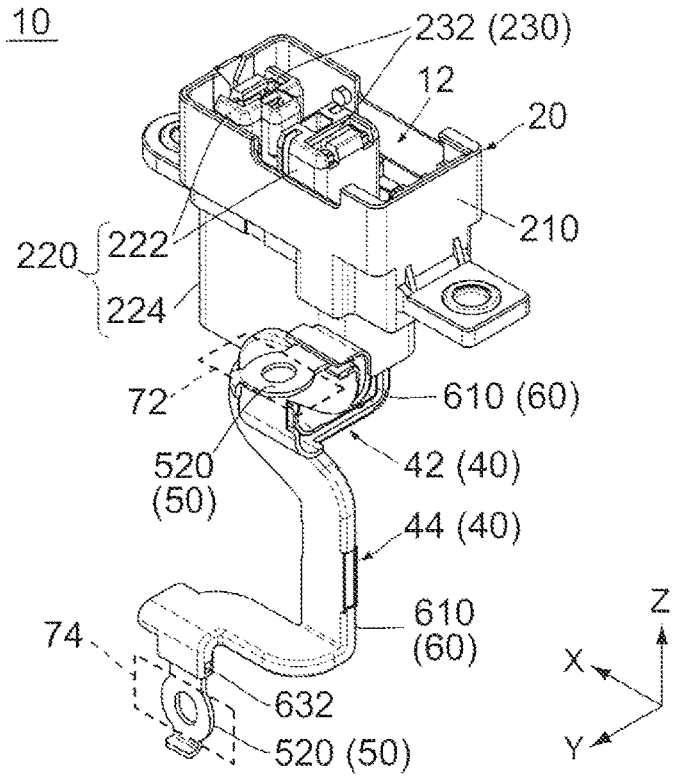
FIG. 1 is a perspective view showing a connector according to an embodiment of the present invention, wherein a part of an object which is to be connected to the connector is schematically illustrated by dashed line.
Figure 2:
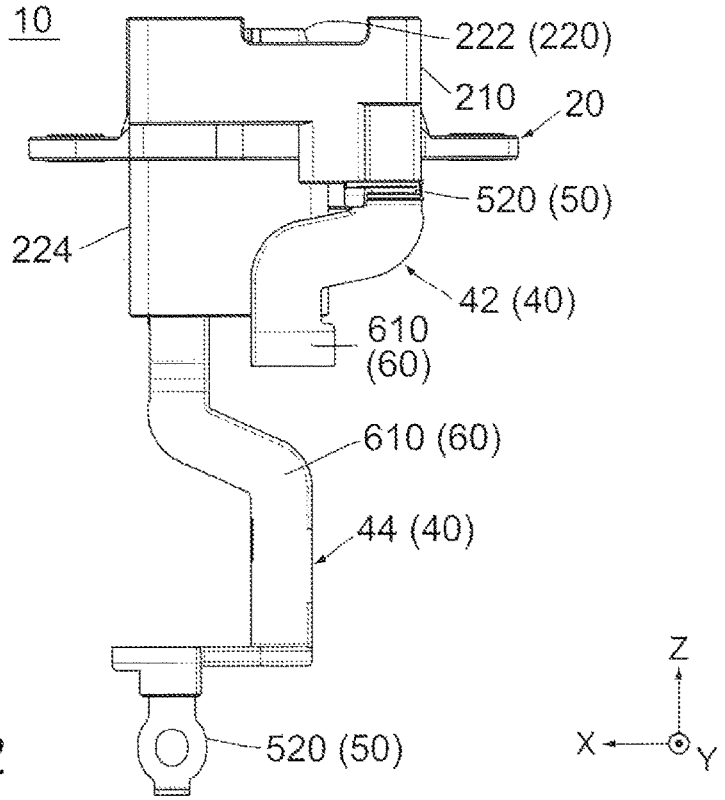
FIG. 2 is a side view showing the connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector 10 according to an embodiment of the present invention is a large current connector which is used, for example, in an electric vehicle such as an electric car. Further referring to FIGS. 18 and 19, the connector 10 is mateable with a mating connector 80 along a mating direction (Z-direction). Under a mated state where the connector 10 and the mating connector 80 are mated with each other, a large current flows through the connector device comprising the connector 10 and the mating connector 80. However, the present invention can be applicable to various connectors different from the aforementioned connector 10.

Figure 18:
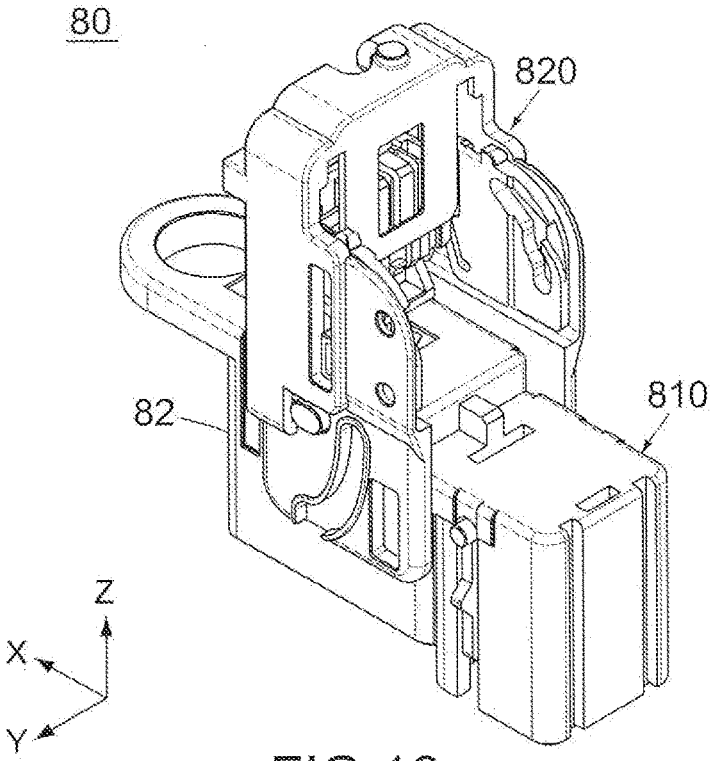
FIG. 18 is a perspective view showing a mating connector mateable with the connection of FIG. 1.
Figure 19:
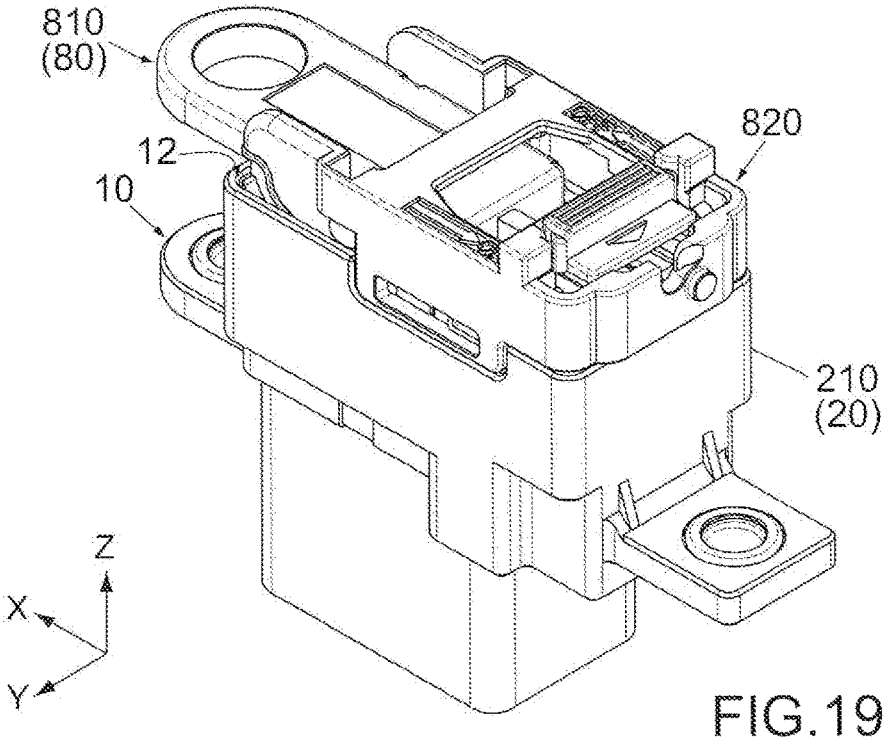
FIG. 19 is a perspective view showing the connector of FIG. 1 and the mating connector of FIG. 18, wherein the connector and the mating connector are mated with each other.

Referring to FIG. 18, the mating connector 80 comprises a mating housing 810 made of insulator and an operation member 820 made of insulator. The operation member 820 is supported by the mating housing 810 so as to be operable. Referring to FIG. 19, the mating connector 80 is mated with the connector 10 by an operation such as a turning operation applied to the operation member 820. Further referring to FIG. 6, the mating connector 80 comprises a mating contact 830 made of conductor. The mating contact 830 according to the present embodiment is a pin which is held by the mating housing 810.

Referring to FIGS. 1 to 5 and 7, the connector 10 according to the present embodiment comprises a housing 20 made of insulator, two contacts 30 each made of conductor and two connection structures 40.

Figure 7:
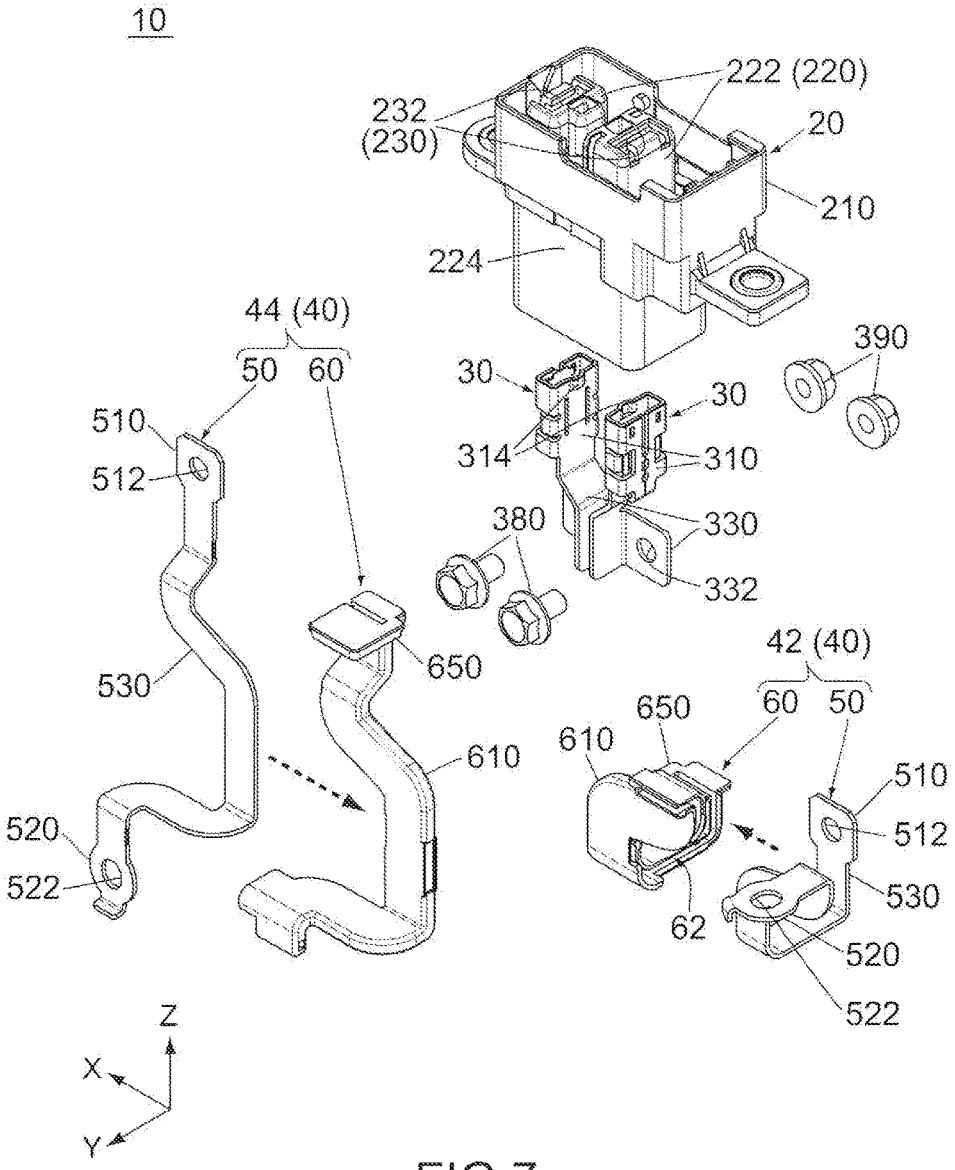
FIG. 7 is an exploded, perspective view showing the connector of FIG. 1.

Referring to FIGS. 1 and 7, the two connection structures 40 include a connection structure 42 and a connection structure 44. The connection structure 42 and the connection structure 44 have shapes different from each other. However, as describe later, the connection structure 42 and the connection structure 44 have basic structures same as each other. In the following explanation, except in explanation in which the connection structure 42 and the connection structure 44 need to be distinguished from each other, each of the connection structure 42 and the connection structure 44 is referred to as the connection structure 40.

Referring to FIG. 7, the two connection structures 40 correspond to the contacts 30, respectively. Thus, the connector 10 according to the present embodiment comprises two connection sets each of which consists of one of the contacts 30 and one of the connection structures 40 corresponding to each other. The connector 10 may comprise three or more of the connection sets or may comprise only one of the connection sets. In other words, the connector 10 may comprise two or more of the contacts 30 and two or more of the connection structures 40 which correspond to the contacts 30, respectively, or may comprise only one of the contacts 30 and only one of the connection structures 40.

Figure 6:
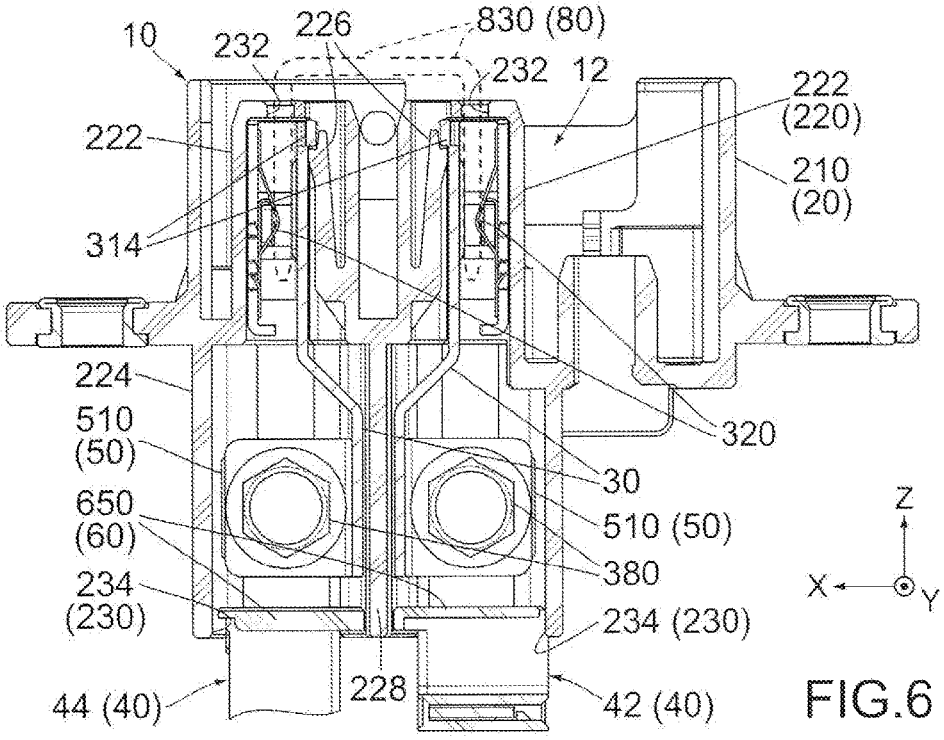
FIG. 6 is a cross-sectional view showing the connector of FIG. 5, taken along line VI-VI, wherein a lower part of one of the connection structures is not illustrated, and an outline of a mating contact of a mating connector mated with the connector is illustrated by dashed line.

Referring to FIGS. 1 and 6, the housing 20 has an outer wall 210. The outer wall 210 is provided to an upper part, or the positive Z-side part, of the housing 20 and has a rectangular cylindrical shape which is long in a front-rear direction (X-direction) and is short in a lateral direction (Y-direction). Referring to FIGS. 1 and 18, the connector 10 has a fit portion 12, and the mating connector 80 has a mating fit portion 82. In the present embodiment, the fit portion 12 is a space enclosed by the outer wall 210, and the mating fit portion 82 is formed of the most part of the mating housing 810 excluding an upper end portion, or the positive Z-side end portion, thereof.

Referring to FIG. 19 together with FIG. 1, under the mated state of the connector 10 with the mating connector 80, the mating fit portion 82 is received in the fit portion 12. In other words, the fit portion 12 according to the present embodiment receives the mating fit portion 82 to be fit to the mating connector 80. However, the present invention is not limited thereto. For example, the fit portion of the connector may be the whole of an upper part of the connector 10 including the outer wall of the housing, and the mating fit portion of the mating connector may be a space formed within the mating housing. In this case, the fit portion is received into the mating fit portion to be fit to the mating connector.

Referring to FIGS. 1 and 6, the housing 20 has a holding portion 220. The holding portion 220 is formed of two upper holding portions 222 and one lower holding portion 224. The upper holding portions 222 are enclosed by the outer wall 210 in the XY-plane, and the lower holding portion 224 is positioned below the outer wall 210, or positioned at the negative Z-side of the housing 20 beyond the outer wall 210. In other words, the upper holding portions 222 are positioned within the fit portion 12, and the lower holding portion 224 is positioned at a side opposite to the fit portion 12 in the Z-direction. The two upper holding portions 222 are apart from each other in the X-direction. Each of the upper holding portions 222 and the lower holding portion 224 has a rectangular cylindrical shape as a whole and extends along the Z-direction.

Referring to FIG. 6, the housing 20 is formed with two accommodation portions 230 which correspond to the two contacts 30, respectively. Each of the accommodation portions 230 is a space formed within the holding portion 220 and extends along the Z-direction. The two accommodation portions 230 are apart from each other in the X-direction and particularly separated from each other. In detail, the two accommodation portions 230 have upper parts, respectively, wherein the upper parts are formed within the two upper holding portions 222, respectively, and this formation separates the two accommodation portions 230 from each other. Moreover, the two accommodation portions 230 have lower parts, or the negative Z-side parts, respectively, wherein the lower parts are formed within the lower holding portion 224 and separated from each other by a separation wall 228.

According to the present embodiment, since the number of the contacts 30 is two, the number of the accommodation portions 230 is two. However, the housing 20 may be formed with two or more of the accommodation portions 230 which correspond to two or more of the contacts 30, respectively. Moreover, when the connector 10 is provided with only one of the contacts 30, only one of the accommodation portions 230 may be formed to correspond to the one contact 30.

As shown in FIGS. 1 and 4 to 6, each of the accommodation portions 230 opens at an upper end of the corresponding upper holding portion 222 and opens at a lower end, or the negative Z-side end, of the lower holding portion 224. In other words, each of the accommodation portions 230 has a first opening 232 and a second opening (opening) 234, wherein the first opening 232 is positioned at the upper end of the corresponding upper holding portion 222, and the second opening 234 is positioned at the lower end of the lower holding portion 224. Each of the first openings 232 is positioned at the fit portion 12. Each of the second openings 234 is positioned at a side opposite to the fit portion 12 in the Z-direction. Thus, in each of the accommodation portions 230, the first opening 232 and the second opening 234 are positioned at opposite sides in the Z-direction, respectively.

Referring to FIGS. 6 and 7, in the present embodiment, the two contacts 30 have shapes which are mirror symmetric to each other with respect to the YZ-plane. Each of the contacts 30 has a body portion 310, a contact portion 320 and an attached portion 330. The body portion 310 has a rectangular cylindrical shape. The body portion 310 is provided with a locked portion 314 which protrudes inward in the X-direction. The contact portion 320 is provided within the body portion 310. The attached portion 330 is positioned below the body portion 310 and has a flat-plate shape. The attached portion 330 is formed with an attachment hole 332. The attachment hole 332 passes through the attached portion 330 in the Y-direction.

Referring to FIG. 6, each of the contacts 30 according to the present embodiment is a socket in which the mating contact 830 is receivable. However, the contact may be a pin which is receivable in the mating contact. Moreover, the two contacts 30 may have shapes same as each other.

Figure 8:
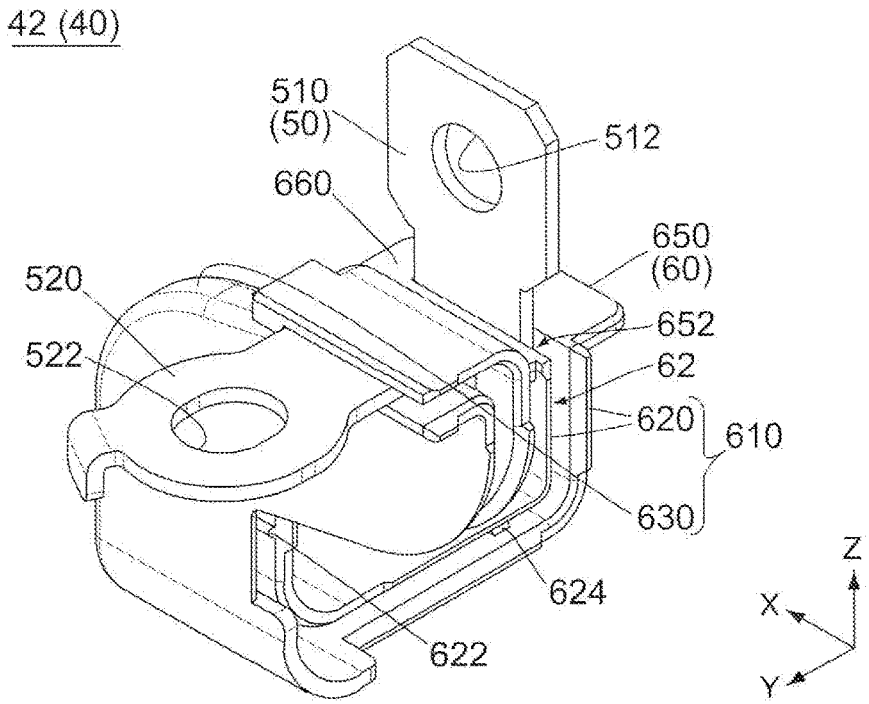
FIG. 8 is a perspective view showing one of the connection structures of the connector of FIG. 1.
Figure 14:
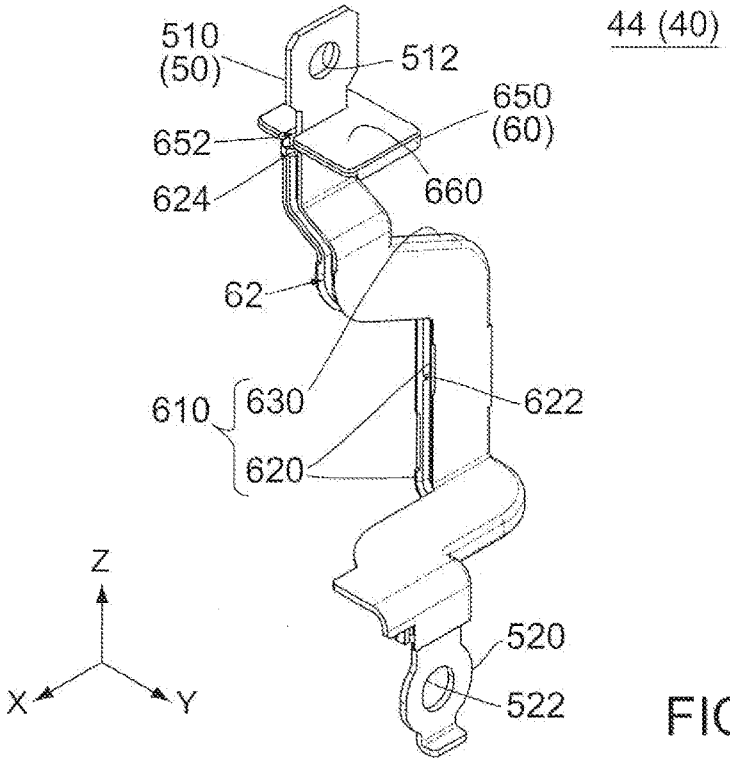
FIG. 14 is a perspective view showing a remaining one of the connection structures of the connector of FIG. 1.
Figure 15:
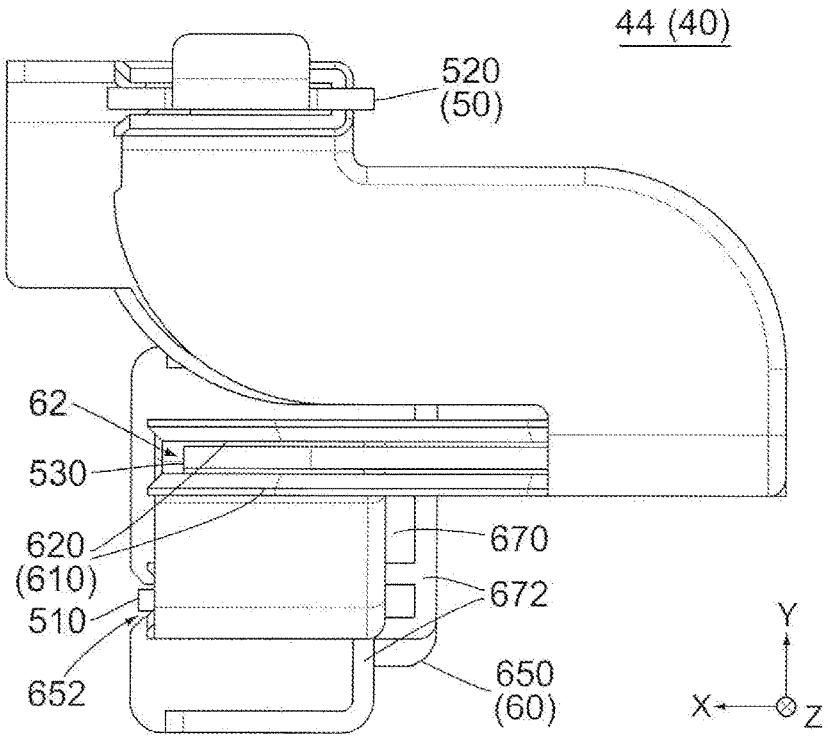
FIG. 15 is a bottom view showing the connection structure of FIG. 14.

Referring to FIGS. 7, 8 and 14, each of the connection structures 40 comprises a conductive member 50 made of metal and a protection member 60 made of insulator. The two conductive members 50 are separated from each other, and the two protection members 60 are separated from each other. Moreover, each of the conductive members 50 is separable from the housing 20, and each of the protection members 60 is separable from the housing 20. In other words, each of the connection structures 40 is a structure other than the housing 20. Moreover, each of the connection structures 40 is a structure other than each of the contacts 30.

Referring to FIG. 7, each of the conductive members 50 is formed by bending a single metal plate having flat-plate shape. In other words, each of the conductive members 50 is a single metal plate with bends. The two conductive members 50 of the connection structure 42 and the connection structure 44 are punched out and bent to have shapes different from each other. However, the two conductive members 50 have basic structures same as each other. More specifically, the conductive member 50 of each of the connection structures 40 has a first end portion (end portion) 510, a second end portion 520 and a body portion 530. In each of the connection structures 40, the body portion 530 extends long with bends, and the first end portion 510 and the second end portion 520 are provided at opposite ends of the body portion 530, respectively.

The body portions 530 of the two conductive members 50 have shapes different from each other. In detail, the body portion 530 of the connection structure 42 is bent so that the first end portion 510 is positioned in the XZ-plane and the second end portion 520 is positioned in the XY-plane. The body portion 530 of the connection structure 44 is bent so that each of the first end portion 510 and the second end portion 520 is positioned in the XZ-plane.

The first end portions 510 of the two conductive members 50 have shapes same as each other and sizes same as each other. In detail, each of the first end portions 510 has a flat-plate shape which is in parallel to the XZ-plane and is formed with an attachment hole 512. The attachment hole 512 passes through the first end portion 510 in the Y-direction. The second end portions 520 of the two conductive members 50 have shapes same as each other and sizes same as each other but are arranged differently. In detail, each of the second end portions 520, excluding its end portion, has a flat-plate shape which is in parallel to a predetermined plane (the XY-plane or the XZ-plane) and is formed with an attachment hole 522. The attachment hole 522 passes through the second end portion 520 in a direction (the Z-direction or the Y-direction) perpendicular to the predetermined plane.

Referring to FIGS. 7, 8 and 14, in each of the connection structures 40, the protection member 60 is molded of a material such as resin to have a shape corresponding to the conductive member 50. Therefore, the two protection members 60 have shapes different from each other. However, the two protection members 60 have basic structures same as each other. More specifically, the protection member 60 of each of the connection structures 40 has a protection portion 610 and an electric-shock prevention portion 650. Thus, each of the connection structures 40 comprises the protection portion 610 and the electric-shock prevention portion 650. In each of the protection members 60, the protection portion 610 extends long with bends like the body portion 530 of the corresponding conductive member 50, and the electric-shock prevention portion 650 is provided at one of ends of the protection portion 610.

According to the present embodiment, in each of the connection structures 40, the electric-shock prevention portion 650 is integrally formed with the protection portion 610. In other words, in each of the connection structures 40, each of the protection portion 610 and the electric-shock prevention portion 650 is a part of the protection member 60. However, the present invention is not limited thereto. For example, the electric-shock prevention portion 650 may be formed separately from the protection portion 610. In other words, the electric-shock prevention portion 650 may be a member other than the protection member 60. In this case, the electric-shock prevention portion 650 may be or may not be attached to the protection portion 610 of the protection member 60.

Figure 12:
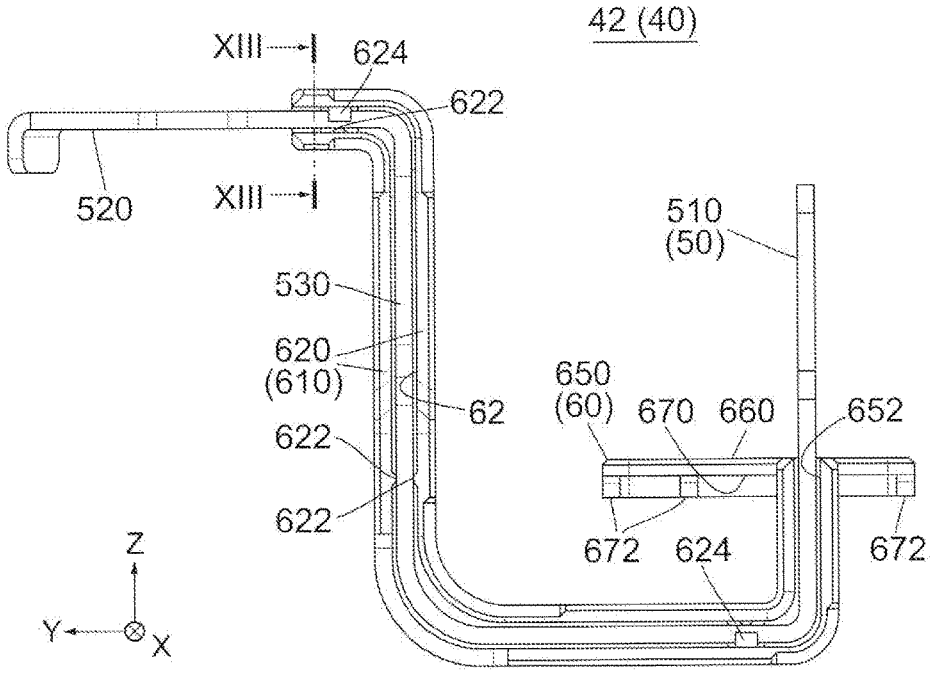
FIG. 12 is a side view showing the connection structure of FIG. 8.
Figure 16:
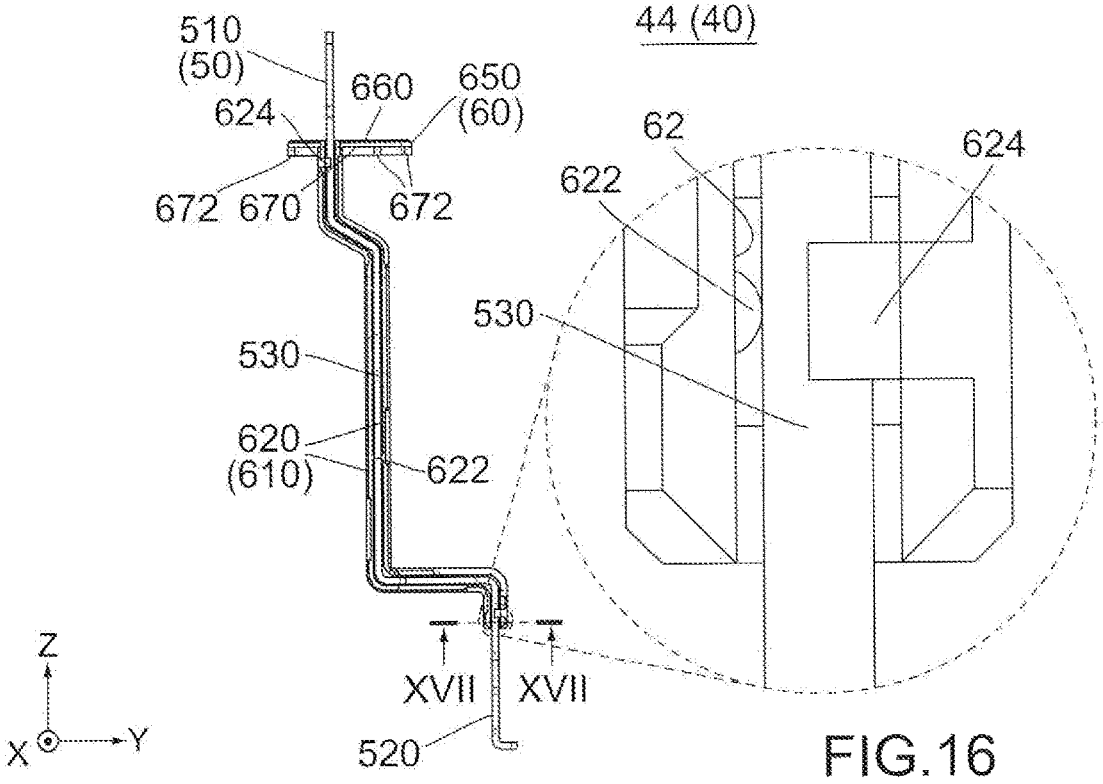
FIG. 16 is a side view showing the connection structure of FIG. 14, wherein a part of the connection structure (part enclosed by dashed line) is enlarged to be illustrated.

Referring to FIGS. 12 and 16, the protection portions 610 of the two protection members 60 are formed to have shapes correspond to the body portions 530 of the conductive members 50, respectively. Therefore, the protection portions 610 have shapes different from each other. In detail, further referring to FIGS. 8 and 14, each of the protection portions 610 has two plate-like portions 620 and one coupling portion 630. In each of the connection structures 40, each of the plate-like portions 620 has a plate shape with bends like the body portion 530 of the conductive member 50. In each of the protection portions 610, the plate-like portions 620 extend in parallel to each other, and the coupling portion 630 couples a predetermined edge of one of the two plate-like portions 620 to a predetermined edge of a remaining one of the two plate-like portions 620. As a result, each of the protection portions 610 is formed with a channel 62. Each of the channels 62 opens at edges opposite to the predetermined edges of the two plate-like portions 620 and opens at opposite ends of the protection portion 610.

The electric-shock prevention portions 650 of the two protection members 60 have shapes similar to each other and sizes similar to each other. In detail, each of the electric-shock prevention portions 650 has a flat-plate shape as a whole and extends in parallel to the XY-plane. Each of the electric-shock prevention portions 650 is formed with a cut 652. In each of the protection members 60, the cut 652 is a space which has a cross-sectional shape same as that of the channel 62 in the XY-plane, so that the channel 62 opens upward, or in the positive Z-direction, via the cut 652.

Referring to FIG. 7, each of the conductive members 50 is inserted in the channel 62 of the corresponding protection member 60. Referring to FIGS. 12 and 16, in each of the connection structures 40, the body portion 530 of the thus-inserted conductive member 50 is accommodated within the channel 62, while the first end portion 510 and the second end portion 520 of the conductive member 50 project out of the opposite ends of the protection portion 610, respectively.

Referring to FIGS. 12, 13, 16 and 17, in each of the connection structures 40, the protection portion 610 of the protection member 60 has a U-like shaped cross-section 64 in a perpendicular plane perpendicular to an extending direction along which the conductive member 50 extends. As can be seen from the positional relation between the cross-section 64 and the body portion 530 shown in FIGS. 13 and 17, in each of the connection structures 40, a part of the conductive member 50, or the body portion 530, is positioned in the cross-section 64, or within the protection portion 610 in the perpendicular plane perpendicular to the extending direction along which the conductive member 50 extends. In other words, in each of the connection structures 40, the conductive member 50 is partially positioned within the channel 62. In particular, in each of the connection structures 40 according to the present embodiment, the body portion 530 of the conductive member 50 is wholly positioned within the channel 62.

Referring to FIGS. 3, 8, 12, 13, 14, 16 and 17, the protection portion 610 of each of the protection members 60 has a plurality of holding sets each of which consists of two holding projections 622. The two holding projections 622 of each of the holding sets are provided to the two plate-like portions 620 of the protection portion 610, respectively, and project toward each other within the channel 62. In each of the connection structures 40, each of the thus-formed holding sets sandwiches the conductive member 50 in a perpendicular direction perpendicular to the extending direction of the conductive member 50 and holds the conductive member 50 within the channel 62.

According to the present embodiment, since each of the protection portions 610 is provided with the holding projections 622, the corresponding conductive member 50 can be securely held within the channel 62. Moreover, in each of the connection structures 40, the conductive member 50 can be smoothly inserted into the channel 62 while surface contact between the conductive member 50 and the plate-like portion 620 can be avoided. Moreover, the provision of the protection portions 610 prevents collision noise between the conductive member 50 and the protection portion 610, which might be generated because of vibration.

The protection portion 610 of each of the protection members 60 has a plurality of coming-off prevention projections 624 in addition to the holding projections 622. In detail, each of the plate-like portions 620 of each of the protection members 60 is provided with one of the coming-off prevention projections 624 which is positioned within the channel 62. In each of the protection members 60, each of the coming-off prevention projections 624 projects from one of the plate-like portions 620 toward a remaining one of the plate-like portions 620 beyond the holding projection 622. In each of the connection structures 40, the thus-formed coming-off prevention projection 624 prevents the conductive member 50, which is held within the channel 62, from coming off the channel 62 of the protection portion 610.

Figure 13:
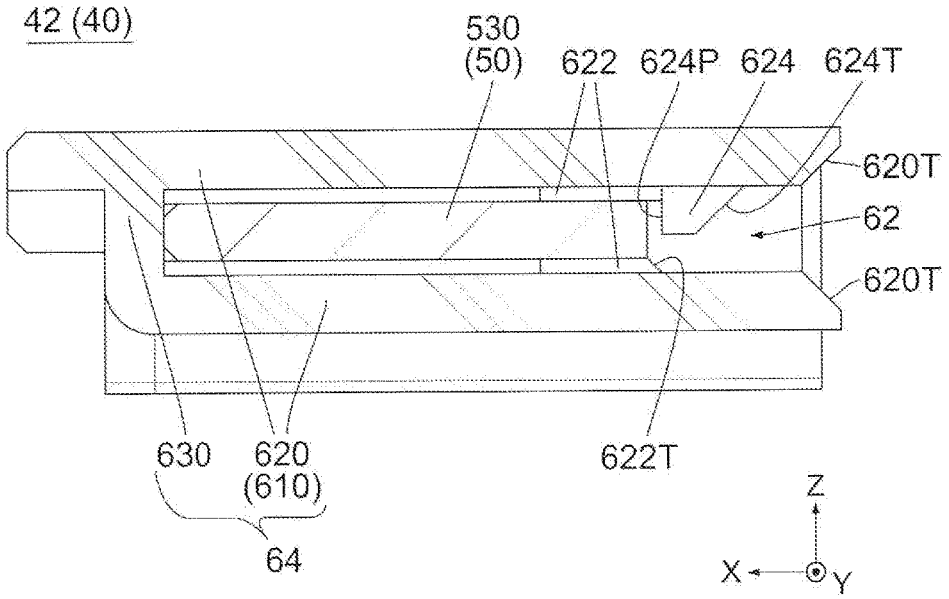
FIG. 13 is a cross-sectional view showing a part of the connection structure of FIG. 12, taken along line XIII-XIII.
Figure 17:
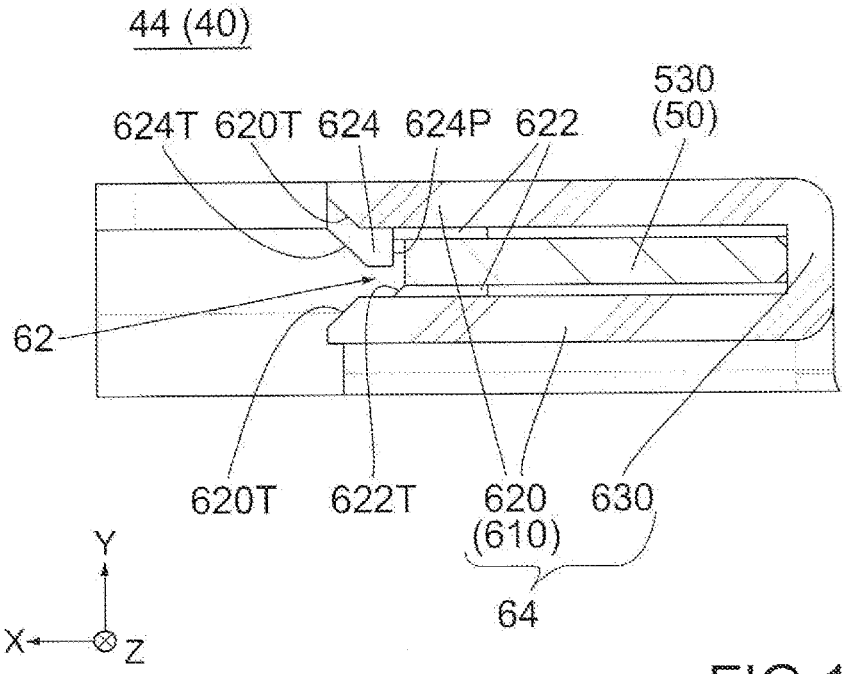
FIG. 17 is a cross-sectional view showing a part of the connection structure of FIG. 16, taken along line XVII-XVII.

Referring to FIGS. 13 and 17, each of the coming-off prevention projections 624 has a perpendicular surface 624P which is positioned within the channel 62. The perpendicular surface 624P is perpendicular to a body-portion-insertion direction, or an insertion direction along which the body portion 530 of the conductive member 50 is inserted into the channel 62, wherein the body-portion-insertion direction according to the present embodiment is one of the positive X-direction and the negative X-direction. The thus-formed perpendicular surface 624P further reliably prevents the conductive member 50 from coming off the channel 62.

Referring to FIGS. 3, 13, 16 and 17, each of the coming-off prevention projections 624 is provided so as to correspond to the two holding projections 622 of one of the holding sets. In detail, each of the coming-off prevention projections 624 is positioned outward of one of the corresponding two holding projections 622 in the aforementioned body-portion-insertion direction and has a tapered surface 624T which is a surface opposite to the perpendicular surface 624P. Moreover, a remaining one of the two holding projections 622 corresponding to the coming-off prevention projection 624 has a tapered surface 622T corresponding to the tapered surface 624T. The tapered surface 622T and the tapered surface 624T, which correspond to each other, slope toward an opening of the channel 62 so as to away from each other. Since the tapered surface 622T and the tapered surface 624T are thus formed, the tapered surface 622T and the tapered surface 624T guide the insertion of the body portion 530 into the channel 62 together with tapered surfaces 620T of the two plate-like portions 620.

Figure 3:
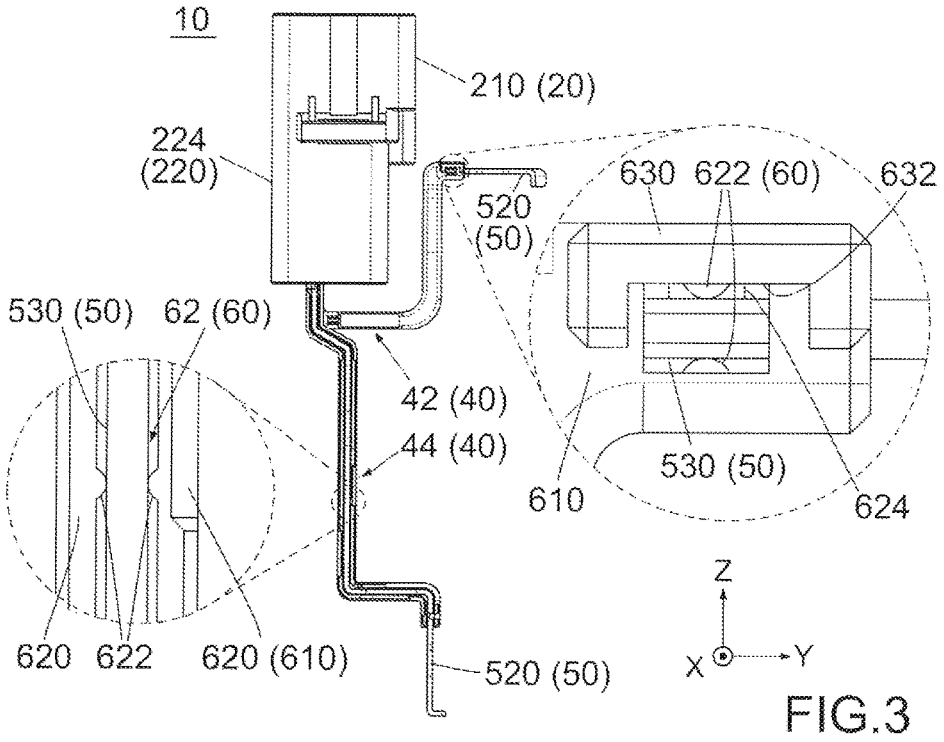
FIG. 3 is a front view showing the connector of FIG. 1, wherein parts of a connection structure of the connector (parts enclosed by dashed line) are enlarged to be illustrated.
Figure 9:
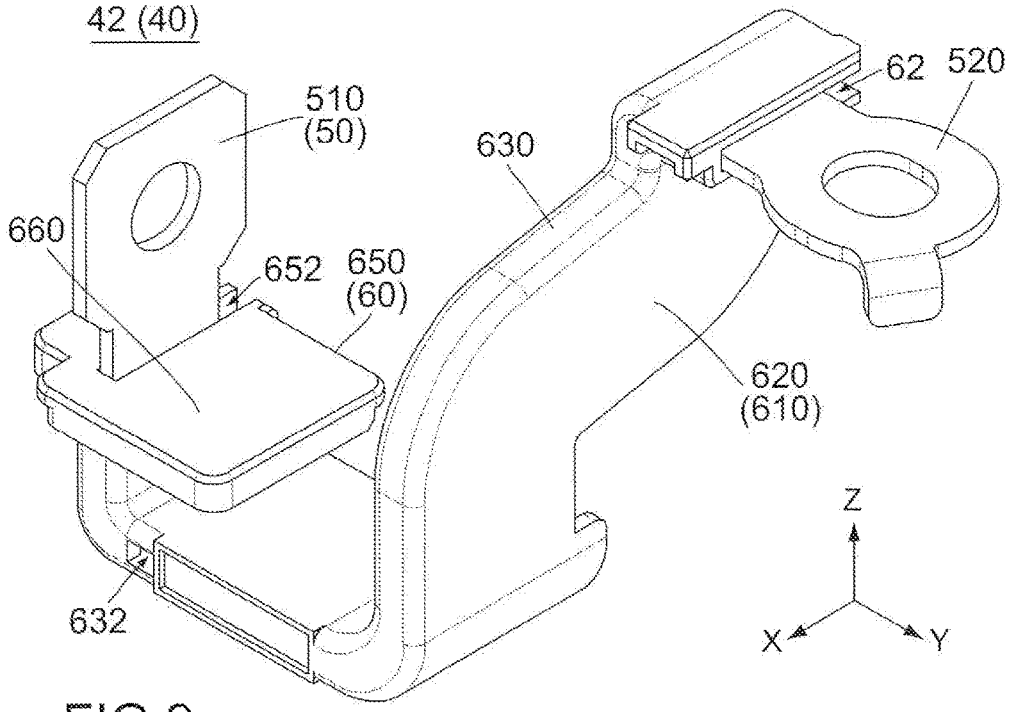
FIG. 9 is another perspective view showing the connection structure of FIG. 8.
Figure 10:
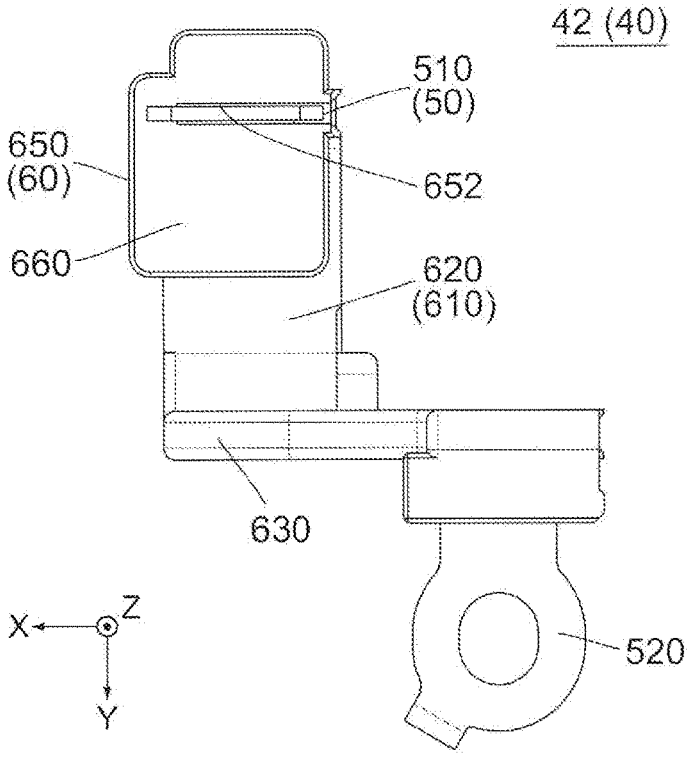
FIG. 10 is a top view showing the connection structure of FIG. 8.
Figure 11:
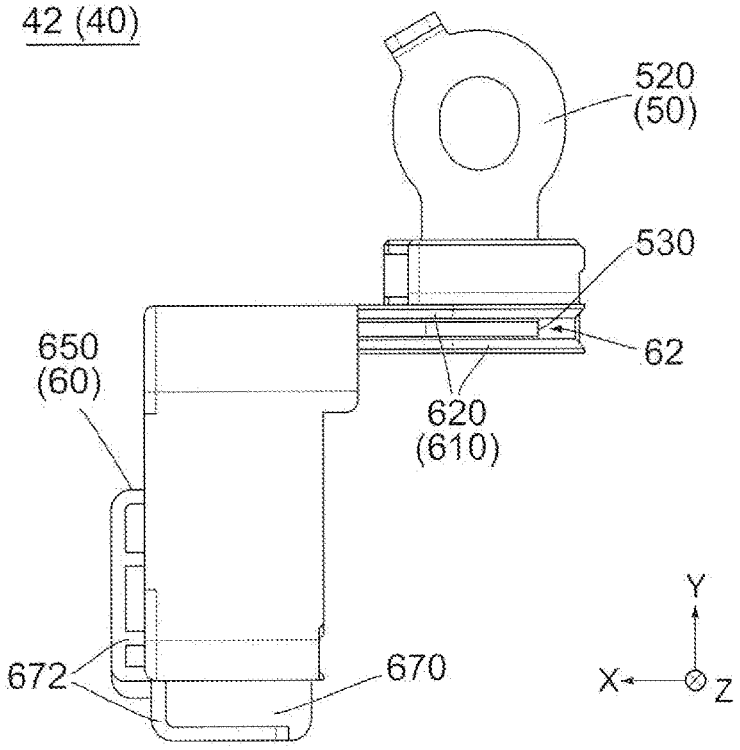
FIG. 11 is a bottom view showing the connection structure of FIG. 8.

Referring to FIGS. 1, 3 and 9, in each of the protection members 60, the coupling portion 630 is formed with a plurality of apertures 632. Referring to FIGS. 3 and 9, some of the holding projections 622 and the coming-off prevention projections 624 are visible through the apertures 632.

As described above, according to the present embodiment, each of the protection members 60 is provided with the holding projections 622 and the coming-off prevention projections 624, so that the body portion 530 of the corresponding conductive member 50 can be smoothly inserted into the channel 62 and can be reliably held within the channel 62. However, the present invention is not limited thereto. For example, each of the holding projections 622 and the coming-off prevention projections 624 may have a shape different from that of the present embodiment. Moreover, the protection member 60 may hold the corresponding conductive member 50 with use of a portion other than the holding projections 622 and the coming-off prevention projections 624. Moreover, the conductive member 50 may be held by the corresponding protection member 60 via insert-molding.

Referring to FIGS. 10 to 12 and 14 to 16, each of the electric-shock prevention portions 650 has an accommodated surface 660 and an exposed surface 670. The accommodated surface 660 is an upper surface, or the positive Z-side surface, of the electric-shock prevention portion 650 while the exposed surface 670 is a lower surface, or the negative Z-side surface, of the electric-shock prevention portion 650. Referring to FIGS. 10, 12, 14 and 16, the accommodated surface 660 is a smooth plane with no irregularities. In contrast, referring to FIGS. 11, 12, 15 and 16, the exposed surface 670 is a plane with irregularities. In detail, the exposed surface 670 is formed with a projecting portion 672 which projects downward. The projecting portion 672 extends along each of the two directions (the X-direction and the Y-direction) perpendicular to each other in the XY-plane.

According to the present embodiment, each of the electric-shock prevention portions 650 is hardly damaged since having the projecting portion 672. However, the present invention is not limited thereto. For example, in a case where there is no need to consider the damage of the electric-shock prevention portion 650, the electric-shock prevention portions 650 does not need to be provided with a portion for preventing the damage such as the projecting portion 672.

Referring to FIGS. 6 and 7, each of the connection structures 40 is attached to the corresponding contact 30 with use of a bolt 380 and a nut 390. In detail, in each of the connection structures 40 according to the present embodiment, the bolt 380 is inserted into the attachment hole 512 and the attachment hole 332 and subsequently screwed into the nut 390, so that the first end portion 510 of the conductive member 50 is attached to the corresponding contact 30. However, the present invention is not limited thereto. For example, the first end portion 510 may be integrally formed with the corresponding contact 30. In other words, each of the contact 30 and the conductive member 50, which correspond to each other, may be a part of a single member. Moreover, even in a case where the contact 30 and the conductive member 50, which correspond to each other, are members other than each other, the contact 30 and the conductive member 50 may be connected to each other via method different from that of the present embodiment.

Referring to FIG. 6, each of the contacts 30 is inserted into the corresponding accommodation portion 230 via the second opening 234 of the accommodation portion 230 and is accommodated in the corresponding accommodation portion 230 together with the first end portion 510 of the conductive member 50 of the corresponding connection structure 40. The locked portion 314 of the contact 30 accommodated in the accommodation portion 230 is locked by a lance 226 of the housing 20, so that the contact 30 is prevented from coming off the housing 20. In other words, each of the connection structures 40 is attached to the housing 20. Under a state where the connection structure 40 is attached to the housing 20, the first end portion 510 of the connection structure 40 is accommodated in the corresponding accommodation portion 230.

In the present embodiment, each of the accommodation portions 230 extends in the Z-direction, and each of the second openings 234 is positioned at a lower end (i.e. a side opposite to the fit portion 12) of the accommodation portion 230. This structure enables the smooth insertion of the contact 30 and the first end portion 510 into the corresponding accommodation portion 230 regardless of the shape of the protection portion 610 (see FIG. 7) of the connection structure 40. However, the position of each of the second openings 234 is not limited to the lower end of the accommodation portion 230, but each of the second openings 234 may be positioned at a part other than the fit portion 12. For example, each of the second openings 234 may be formed in a side surface of the lower holding portion 224, or a surface enclosing the accommodation portion 230 in the XY-plane.

Referring to FIG. 1, when the connector 10 is used, the second end portion 520 of the connection structure 42 is connected to an object 72, and the second end portion 520 of the connection structure 44 is connected to an object 74. Further referring to FIG. 6, under the mated state, the contact portions 320 of the two contacts 30 are connected to the mating contact 830, so that the object 72 and the object 74 are electrically connected with each other.

Figure 4:
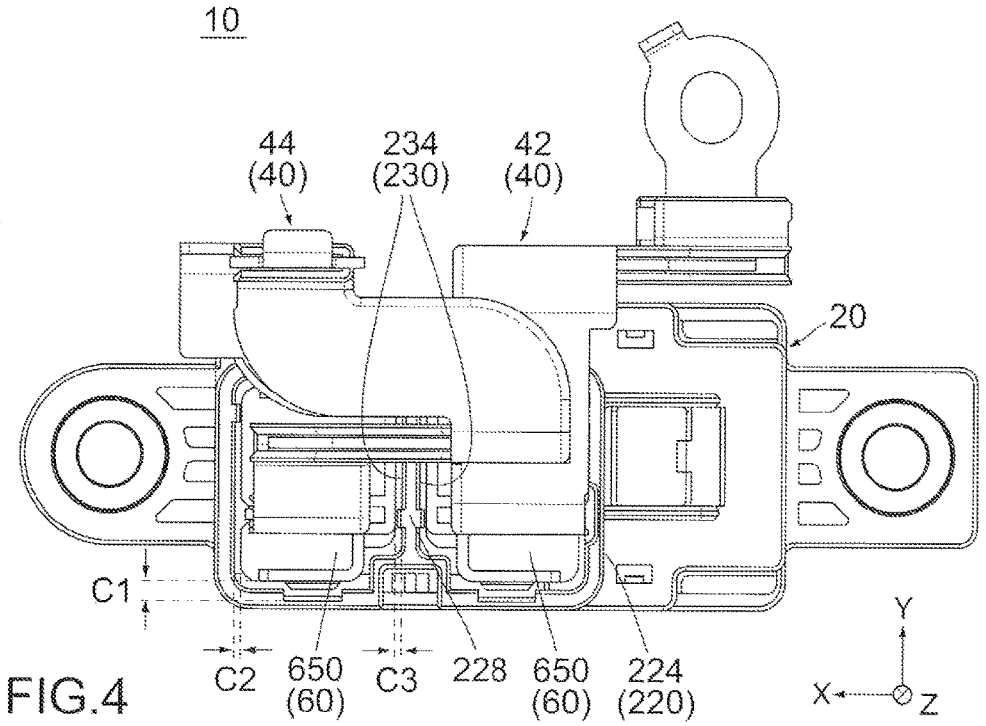
FIG. 4 is a bottom view showing the connector of FIG. 1.
Figure 5:
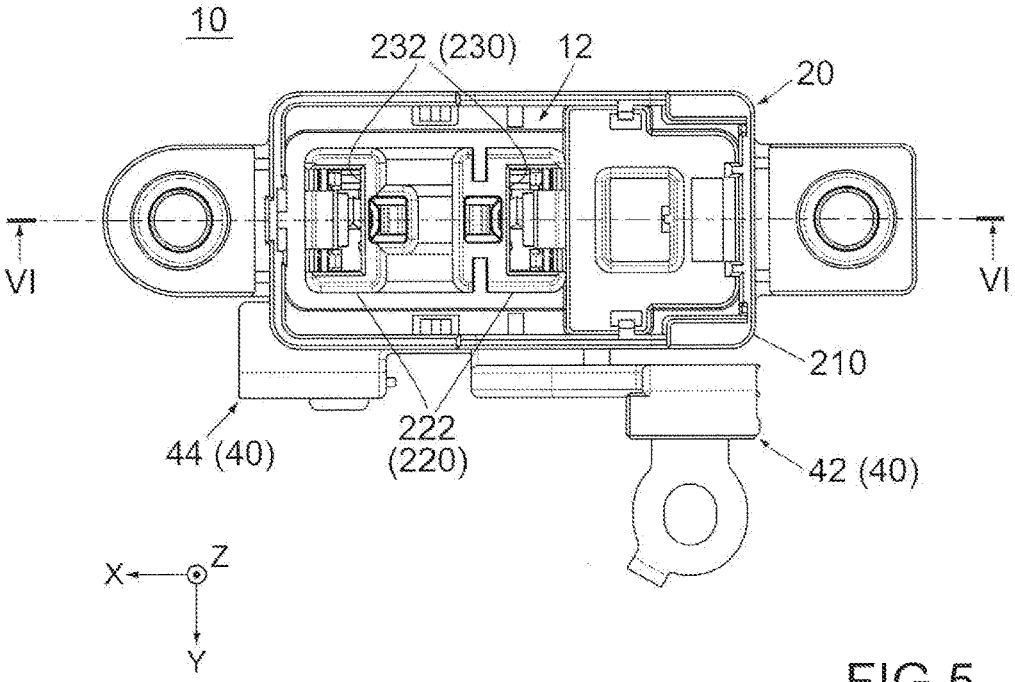
FIG. 5 is a top view showing the connector of FIG. 1.

Referring to FIGS. 1 to 3 and 7, in each of the connection structures 40, the protection portion 610 of the protection member 60 covers the body portion 530, or a part of the conductive member 50, which is positioned between the first end portion 510 and the second end portion 520. This cover prevents electric shock which might be caused because of contact with the body portion 530. Referring to FIGS. 4 and 6, each of the electric-shock prevention portions 650, at least in part, blocks the second opening 234 of the corresponding accommodation portion 230 and obstructs entrance of a finger into the accommodation portion 230 beyond the electric-shock prevention portion 650. In detail, even if an end of the finger slightly enters into the accommodation portion 230 beyond the electric-shock prevention portion 650, the finger cannot enter into the accommodation portion 230 so deep as the finger is brought into contact with the conductive body such as the contact 30 and the first end portion 510. Therefore, the electric shock, which might be caused because of contact with the contact 30 or the first end portion 510, is prevented.

Referring to FIGS. 4 and 6, in the present embodiment, each of the electric-shock prevention portions 650 is inserted into and accommodated in the corresponding accommodation portion 230. Referring to FIG. 4, any part of each of the electric-shock prevention portions 650 has a minimum distance (C1, C2, C3, etc.) of equal to or less than 12 mm, wherein the minimum distance is a distance between the part of the electric-shock prevention portion 650 and the wall which consists of the lower holding portion 224 and the separation wall 228 of the housing 20. In other words, the connector 10 has a clearance of 12 mm or less which is provided between each of the electric-shock prevention portions 650 and the housing 20, so that the finger is prevented from passing the electric-shock prevention portion 650.

However, the present invention is not limited thereto. For example, each of the electric-shock prevention portions 650 may be attached to the housing 20 in a manner different from that of the present embodiment, provided that the electric-shock prevention portions 650 are provided so that the connector 10 meets the protection level of IP-XXB of International Electrotechnical Commission (IEC) 60529. For example, each of the electric-shock prevention portions 650 may cover the second opening 234 of the corresponding accommodation portion 230 from below.

Referring to FIG. 7, in the present embodiment, each of the conductive members 50 is made of a material which is bendable and is capable of keeping a bent shape. For example, each of the conductive members 50 is made of a plate-like metal member. Therefore, each of the conductive members 50 can be shaped in various shapes in accordance with usage of the connector 10. Thus, each of the connection structures 40 may have various shapes.

As previously described, the two connection structures 40 according to the present embodiment, namely, the connection structure 42 and the connection structure 44, have bent shapes different from each other. However, the present invention is not limited thereto. For example, the two connection structures 40 may have bent shapes similar to each other. Moreover, each of the connection structures 40 may have a linear shape with no bend. Moreover, the conductive member 50 may have a rod shape such as a rounded rod shape or a rectangular rod shape. In this case, the conductive member 50 may have an end which works as a pin contact.

The connector 10 according to the present embodiment can be further variously modified in addition to the already explained modifications.

Figure 20:
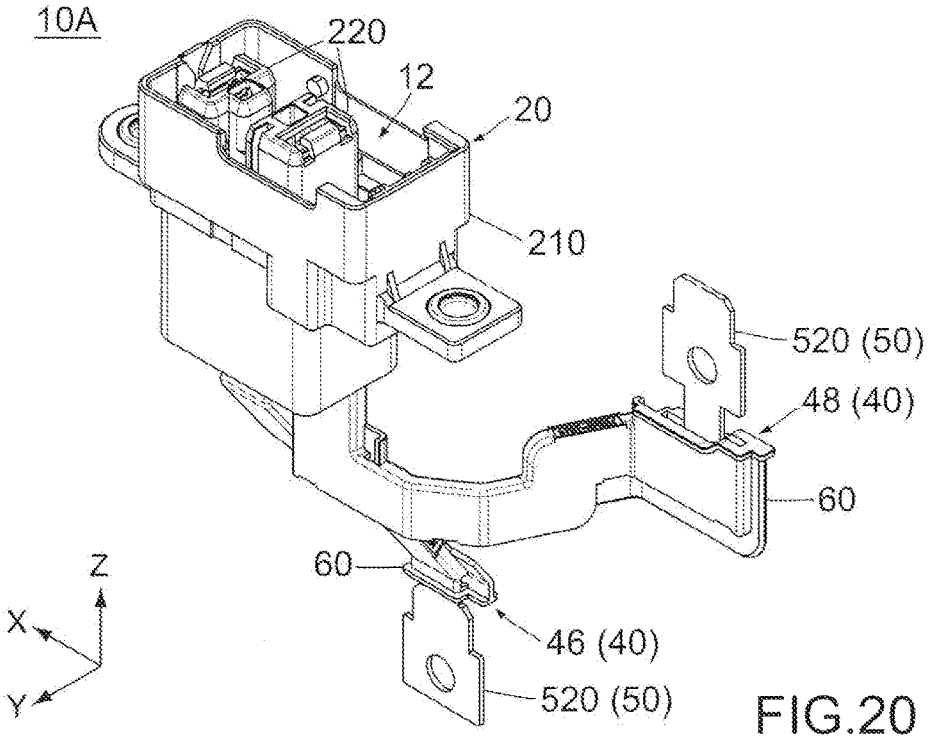
FIG. 20 is a perspective view showing a modification of the connector of FIG. 1.
Figure 21:
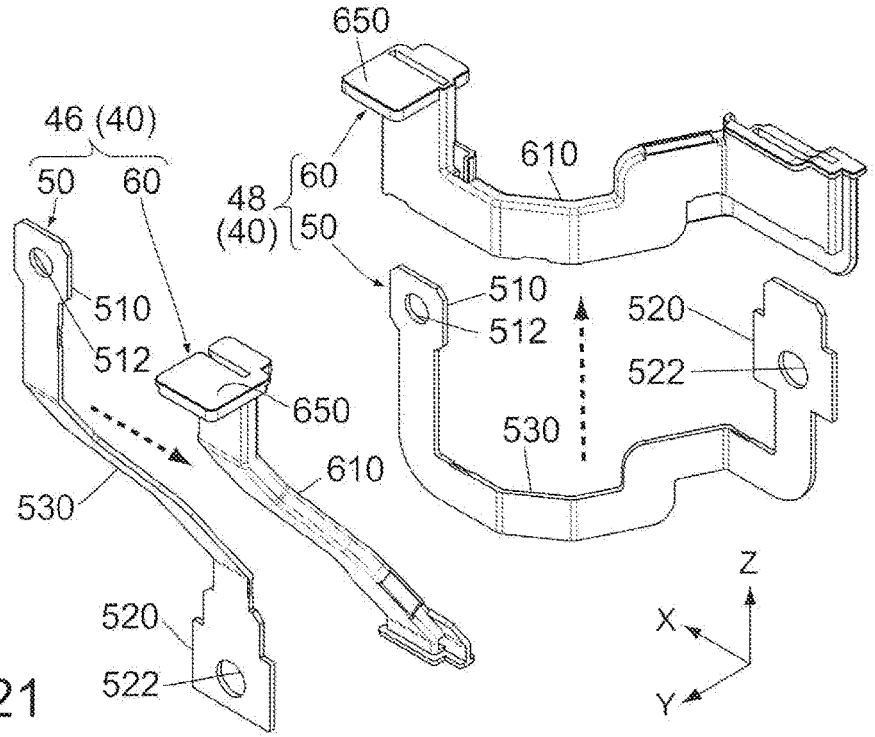
FIG. 21 is an exploded, perspective view showing two connection structures of the connector of FIG. 20.

Referring to FIGS. 20 and 21, a connector 10A according to a modification of the present embodiment comprises the housing 20 and the contacts 30 same as those of the connector 10 (see FIG. 7), while comprising a connection structure 46 and a connection structure 48 which are different from the connection structure 42 and the connection structure 44 of the connector 10.

Figure 22:
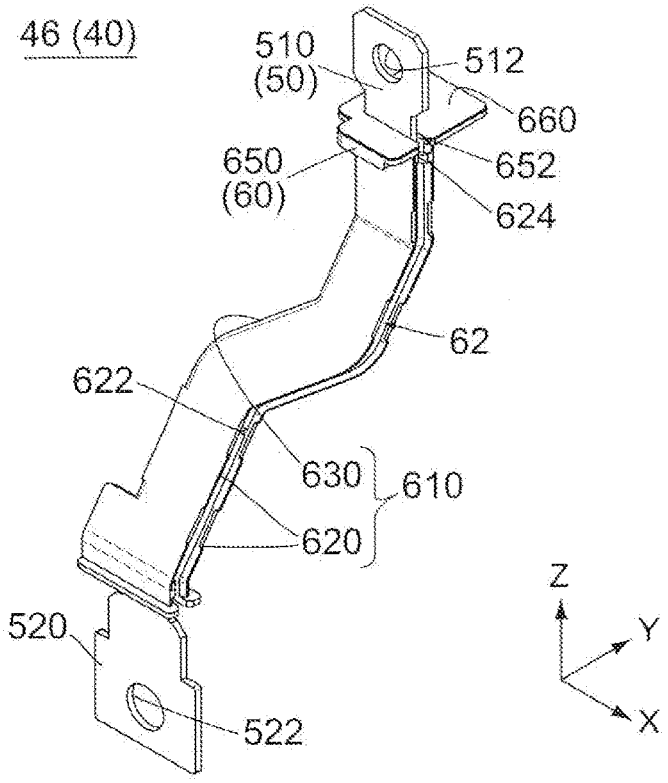
FIG. 22 is a perspective view showing one of the connection structures of the connector of FIG. 20.
Figure 23:
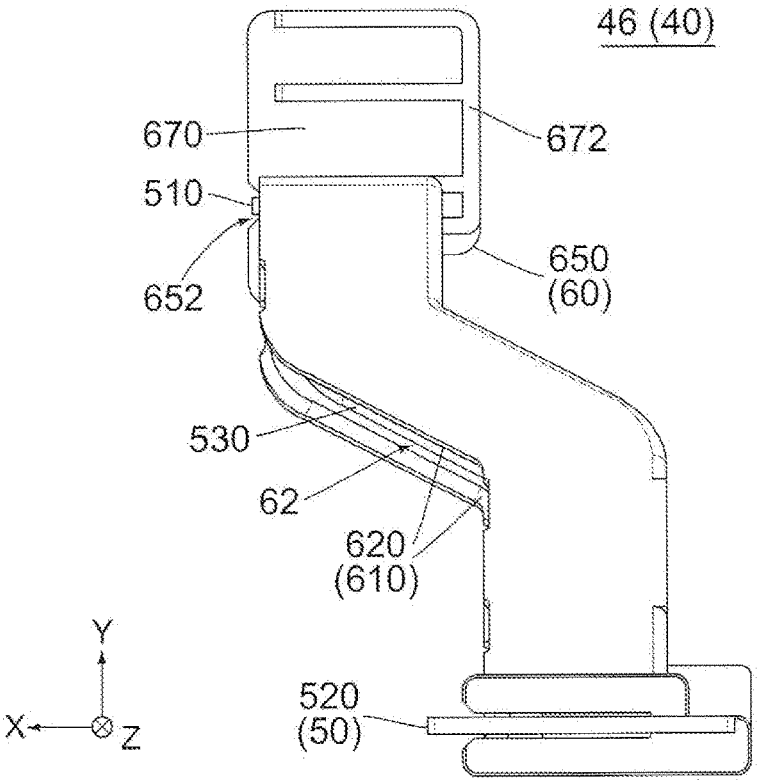
FIG. 23 is a bottom view showing the connection structure of FIG. 22.

Referring to FIGS. 22 and 23, the connection structure 46 has bends different from those of the connection structure 42 (see FIGS. 9 and 11) and the connection structure 44 (see FIGS. 14 and 15), while having a basic structure similar to those of the connection structure 42 and the connection structure 44. Similarly, referring to FIGS. 24 and 25, the connection structure 48 has bends different from those of the connection structure 42 and the connection structure 44, while having a basic structure similar to those of the connection structure 42 and the connection structure 44.

Figure 24:
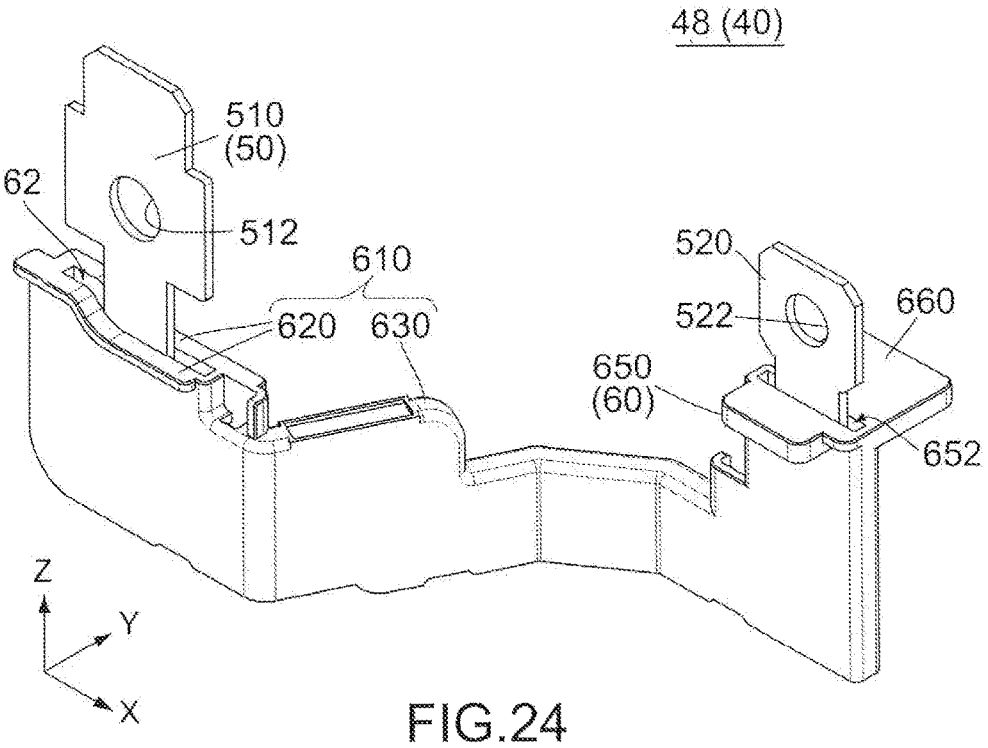
FIG. 24 is a perspective view showing a remaining one of the connection structures of the connector of FIG. 20.
Figure 25:
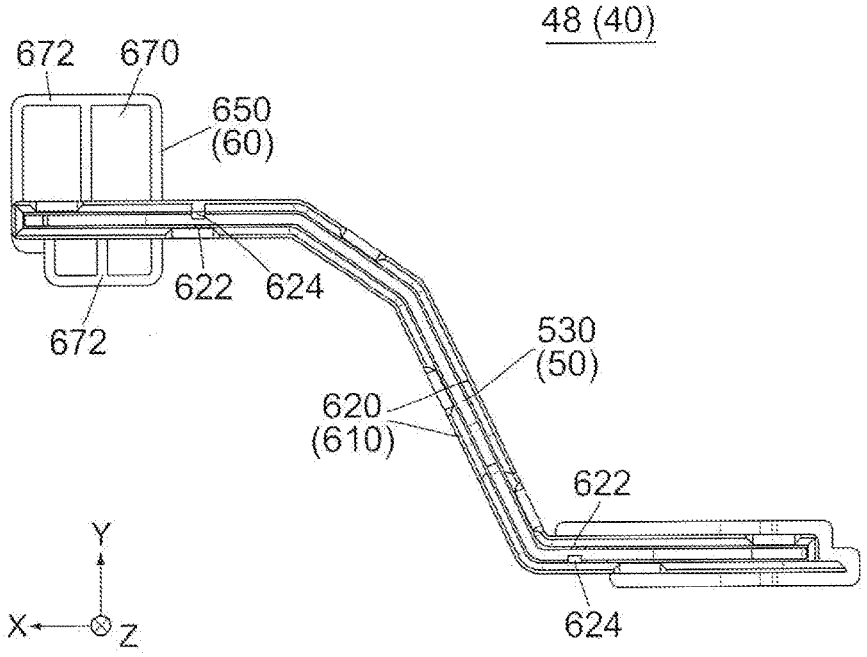
FIG. 25 is a bottom view showing the connection structure of FIG. 24.
Figure 26:
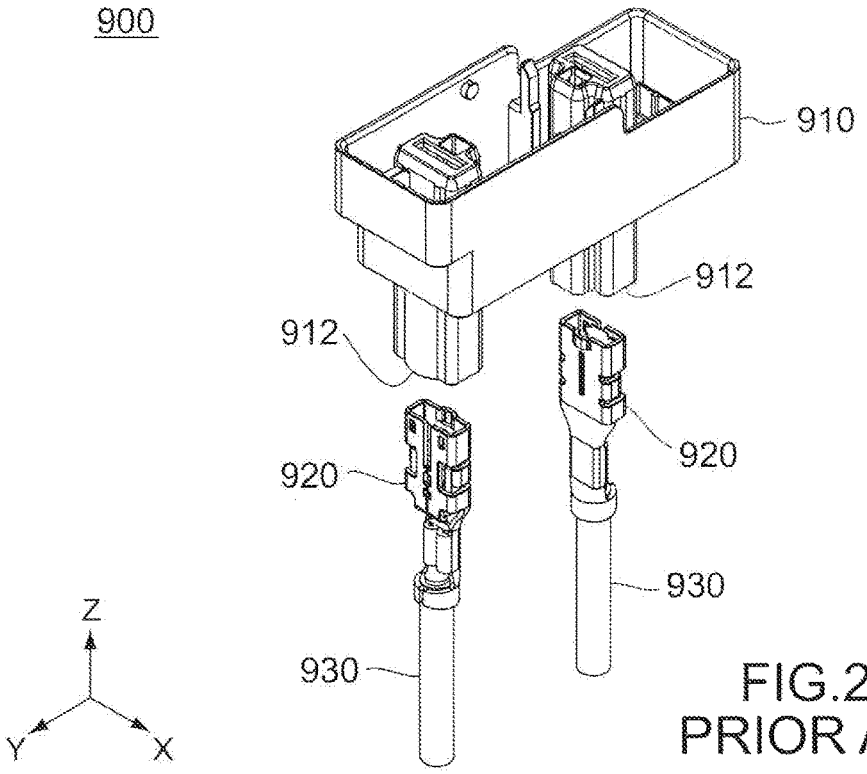
FIG.26 PRIOR ART
FIG. 26 is an exploded, perspective view showing a connector of Patent Document 1.
Figure 27:
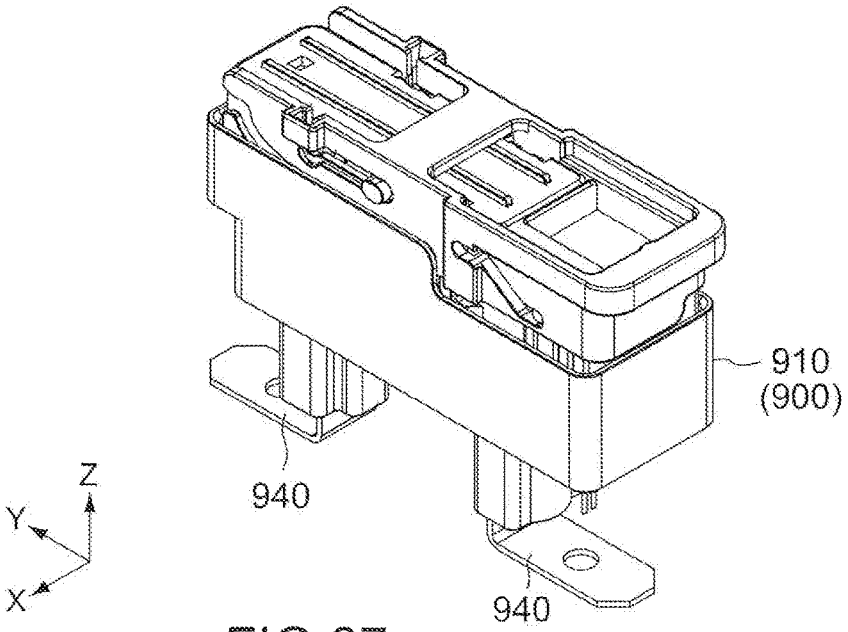
FIG.27 PRIOR ART
FIG. 27 is a perspective view showing a modification of the connector and a mating connector of Patent Document 1, wherein the connector and the mating connector are mated with each other.

Referring to FIG. 24, the electric-shock prevention portion 650 of the connection structure 48 is formed with the cut 652 which is a hole passing through the electric-shock prevention portion 650 unlike the cut 652 of the connection structure 42 (see FIG. 9). As can be seen from the above description, the protection member 60 of the connection structure 40 may be shaped into various shapes in accordance with the shape of the conductive member 50. For example, although both the protection portion 610 and the electric-shock prevention portion 650 described above are formed of a single member, each of the protection portion 610 and the electric-shock prevention portion 650 may be formed by combining two or more members.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector having a fit portion fittable to a mating connector, wherein:

the connector comprises a housing, a contact and a connection structure;

the connection structure is a structure other than the housing and comprises a conductive member, a protection portion and an electric-shock prevention portion;

the conductive member has a first end portion and a second end portion;

the first end portion is attached to or integrally formed with the contact;

the protection portion covers a part of the conductive member, which is positioned between the first end portion and the second end portion;

the housing has an accommodation portion formed therewithin;

the accommodation portion has a first opening and a second opening;

the first opening is positioned at the fit portion;

the second opening is positioned at a part other than the fit portion;

the contact is accommodated in the accommodation portion together with the first end portion of the conductive member;

the electric-shock prevention portion, at least in part, blocks the second opening of the accommodation portion and obstructs entrance of a finger into the accommodation portion beyond the electric-shock prevention portion; and the protection portion has a U-like shaped cross-section in a perpendicular plane perpendicular to an extending direction along which the conductive member extends.

2. The connector as recited in claim 1, wherein the connection structure is a structure other than the contact.

3. The connector as recited in claim 1, wherein the electric-shock prevention portion is attached to or integrally formed with the protection portion.

4. The connector as recited in claim 1, wherein the electric-shock prevention portion is accommodated in the accommodation portion.

5. The connector as recited in claim 4, wherein the connector has a clearance of 12 mm or less which is provided between the electric-shock prevention portion and the housing.

6. The connector as recited in claim 1, wherein:

the connector is mateable with the mating connector along a mating direction; and the second opening is positioned at a side opposite to the fit portion in the mating direction.

7. The connector as recited in claim 1, wherein the conductive member is made of a material which is bendable and is capable of keeping a bent shape.

8. The connector as recited in claim 7, wherein the conductive member is made of a plate-like member.

9. The connector as recited in claim 1, wherein the protection portion is formed of a single member.

10. The connector as recited in claim 9, wherein:

the conductive member has a part which is positioned within the protection portion in the perpendicular plane; and the protection portion has a coming-off prevention projection which prevents the conductive member from coming off the protection portion.

11. The connector as recited in claim 10, wherein:

the protection portion has two holding projections; and the two holding projections sandwich the conductive member in a direction perpendicular to the extending direction and hold the conductive member within the protection portion.

12. The connector as recited in claim 1, wherein the electric-shock prevention portion is provided so that the connector meets protection level of IP-XXB of International Electrotechnical Commission (IEC) 60529.

13. A connector having a fit portion fittable to a mating connector, wherein:

the connector comprises a housing, two or more contacts and two or more connection structures;

the connection structures are separated from one another and correspond to the contacts, respectively;

each of the connection structures is a structure other than the housing and comprises a conductive member, a protection portion and an electric-shock prevention portion;

in each of the connection structures, the conductive member has a first end portion and a second end portion, the first end portion is attached to or integrally formed with the corresponding contact, and the protection portion covers a part of the conductive member, which is positioned between the first end portion and the second end portion;

the housing has two or more accommodation portions formed therewithin;

the accommodation portions correspond to the contacts, respectively, and are separated from one another;

each of the accommodation portions has a first opening and a second opening;

each of the first openings is positioned at the fit portion;

each of the second openings is positioned at a part other than the fit portion;

each of the contacts is accommodated in the corresponding accommodation portion together with the first end portion of the conductive member of the corresponding connection structure;

each of the electric-shock prevention portions, at least in part, blocks the second opening of the corresponding accommodation portion and obstructs entrance of a finger into the accommodation portion beyond the electric-shock prevention portion; and each of the protection portions has a respective U-like shaped cross-section in a perpendicular plane perpendicular to an extending direction along which the conductive member extends.

14. A connection structure attachable to a housing of a connector, the housing being formed with an accommodation portion having an opening, wherein:

the connection structure comprises a conductive member, a protection portion and an electric-shock prevention portion;

the conductive member has a first end portion and a second end portion;

the protection portion covers a part of the conductive member, which is positioned between the first end portion and the second end portion;

under a state where the connection structure is attached to the housing, the first end portion is accommodated in the accommodation portion, and the electric-shock prevention portion, at least in part, blocks the opening of the accommodation portion and obstructs entrance of a finger into the accommodation portion beyond the electric-shock prevention portion; and the protection portion has a U-like shaped cross-section in a perpendicular plane perpendicular to an extending direction along which the conductive member extends.

* * * * *